US006889450B2

(12) United States Patent
Laramore et al.

(10) Patent No.: US 6,889,450 B2
(45) Date of Patent: May 10, 2005

(54) FLUIDIZED BED SEED DRYER

(75) Inventors: Jerry Laramore, Meridian, ID (US); John Clark, Boise, ID (US)

(73) Assignee: Agra Air, Inc., Boise, ID (US)

( * ) Notice: Subject to any disclaimer, the term of this patent is extended or adjusted under 35 U.S.C. 154(b) by 0 days.

(21) Appl. No.: 10/448,152

(22) Filed: May 29, 2003

(65) Prior Publication Data

US 2004/0237336 A1 Dec. 2, 2004

(51) Int. Cl.[7] ..... F26B 17/00
(52) U.S. Cl. ..... 34/588; 34/582; 34/579; 34/585
(58) Field of Search ..... 34/576, 582, 583, 34/585, 588, 167, 168

(56) References Cited

U.S. PATENT DOCUMENTS 3,298,793 A * 1/1967 Mallison et al. ..... 422/143
3,370,361 A * 2/1968 Guerrieri ..... 34/583
3,921,663 A * 11/1975 Beranek et al. ..... 137/533.11
4,064,636 A 12/1977 Downing
4,574,496 A * 3/1986 Sedlacek ..... 34/585
4,764,347 A * 8/1988 Milligan ..... 422/113
4,841,884 A * 6/1989 Engstrom et al. ..... 110/298
5,391,356 A * 2/1995 Thorman ..... 422/143
5,893,218 A 4/1999 Hunter et al.

* cited by examiner

*Primary Examiner*—Denise L. Esquivel
*Assistant Examiner*—Kathryn S. O'Malley
(74) *Attorney, Agent, or Firm*—Holland & Hart LLP

(57) ABSTRACT

The present invention provides a seed dryer having an air kettle. The air kettle defines a seedbed. A plenum and diffuser direct air from an air supply to the bottom of the seedbed without the need for screens. The air from the air supply is provided with sufficient pressure that the seedbed is fluidized which decreases the need for mechanical agitation of the seeds.

18 Claims, 4 Drawing Sheets

FLUIDIZED BED SEED DRYER

FIELD OF THE INVENTION

The present invention relates to seed dryers and, more particularly, the present invention relates to an apparatus and method for reducing seed moisture content.

BACKGROUND OF THE INVENTION

In the agricultural industry, seeds are frequently harvested at moisture levels that inhibit safe and long term storage of the seeds. While high moisture content inhibits safe and long term storage, crops are harvested with moisture content to help prevent seeds degradation from things such as, for example, insects, diseases, exposures (such as weather), or the like.

The high moisture content of the harvested seeds inhibits safe, long-term storage. Thus, the high moisture seeds are artificially dried to bring the seeds down to an acceptable moisture level. The drying process occurs under controlled conditions to maximize the quality of the seed products. Controlled drying conditions are necessary because the rate and temperature of drying can influence the seeds' germination and storability.

One type of conventional apparatus and method for drying moist seeds includes placing the moist seeds in a bin. The moist seeds form a seedbed above a bottom of the bin. The bottom of the bin typically contains perforations or holes. Placing the bins over a plenum allows hot, dry air to be forced up through the perforations in the bottom of the bin and through the seedbed. The hot, dry air removes moisture from the moist seeds making them dry seeds. Alternatively, the bins can be placed in a drying chamber, here air is heated and circulated within the chamber, similar to an oven. In either case, the seeds need to be stirred or agitated to effectuate even drying. In some apparatuses, the bins are moved over various airflows using conveyor belts.

Another type of seed dryer is a two-pass dryer. A two-pass dryer typically has hot air from an upper plenum forced through the seed from the top to the bottom. The air passes through the perforations in the bottom of the bin and enters a lower plenum. The pass through the seeds reduces the air temperature and increases the relative humidity. The lower temperature, higher humidity air from the lower plenum is directed to a second bin. The air passes through bottom perforations in the second bin, passes through a second seedbed from bottom to top and is typically exhausted to the atmosphere. Similar to the above, the seeds need to be stirred or agitated to effectuate even drying.

The perforations at the bottoms of the bins typically are as large as possible to permit maximum airflow with minimum resistance, but the size of the perforations is limited by the size of the seeds being dried. Thus, for a single dryer to dry multiple types of seeds, the perforations, which are typically contained in a screen, need to be changed with each seed change. Further, seeds still log in the perforations causing reduced flow and potential seed damage, and requiring cleaning of the perforations.

Thus it would be desirable to design an improved seed dryer.

SUMMARY OF THE INVENTION

To attain the advantages and in accordance with the purpose of the invention, as embodied and broadly described herein, a seed dryer is provided. The seed dryer comprises an air kettle having a sidewall that defines a seedbed with a plenum. The plenum resides in the seedbed and has an air supply path and at least one outside wall. The plenum, seedbed, and diffuser operate in conjunction to direct drying air to the bottom of a seedbed.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
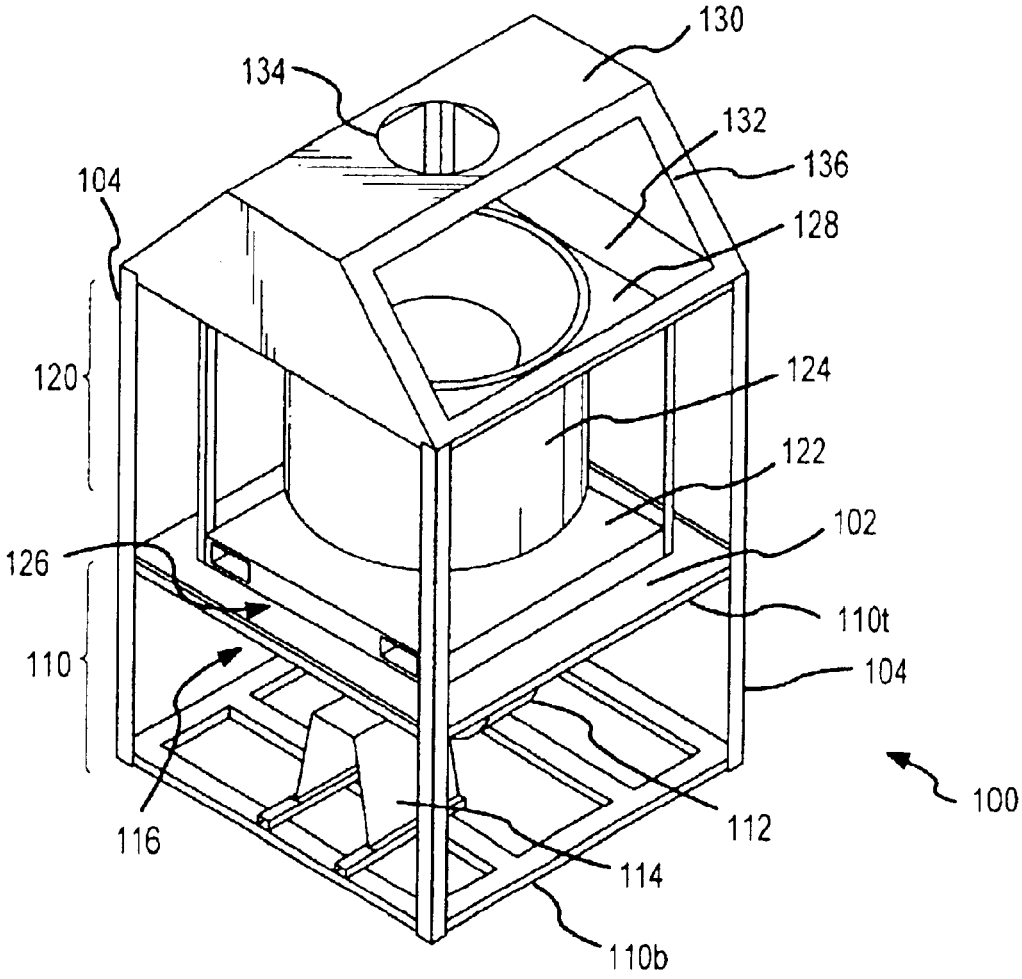
FIG. 1 shows a perspective view of a seed dryer consistent with at least one embodiment of the present invention.

The present invention will be described with reference to FIGS. 1–4. Referring first to FIG. 1, a seed dryer 100 is shown. Dryer 100 includes a fan compartment 110, a kettle compartment 120, and an exhaust hood 130. The compartments 110 and 120 are generally shown as open structures using supports 104, but could be enclosed by sidewalls if desired. Further, compartment 110, compartment 120, and exhaust hood 130 are described as separate units for convenience, but one of ordinary skill in the art would recognize on reading the below disclosure, dryer 100 could be a modular unit as described or a single integrated unit, or a combination thereof.

Fan compartment 110 includes a fan 112 (which is seen more clearly in FIG. 2) and a fan motor 114. Fan motor 114 receives power from a power source, such as from a conventional power line, generator, or battery source (not shown). A fan compartment airway opening 116 exists in the compartment top 110*t*. Fan 112 is connected to an air supply (not shown) and moves drying air from the supply and out of fan compartment 110 through airway opening 116. While air circulation is described using fan 112, other devices could be used such as, for example, a blower, jets, or the like. In this application the term air is used because hot, dry air is the conventional form of gas used to dry moist seeds; however, one of ordinary skill in the art would recognize after reading this disclosure that other gases could be used, so the term air should be used generically to mean any drying gas.

Kettle compartment 120 contains a kettle base 122, an air kettle 124, an air kettle airway opening 126, and an air kettle exhaust opening 128. Residing between fan compartment 110 and kettle compartment 120 is a gasket 102 or other sealant to inhibit leakage of the hot, dry air. Air kettle 124 contains a number of components that will be explained in more detail below.

Exhaust hood 130 contains an exhaust airway opening 132, a vent 134, and optionally, a viewing window 136. Viewing window 136 may be open, a clear surface, such as, glass or clear plastic, or a panel hingedly connected to exhaust hood 130.

Figure 2:
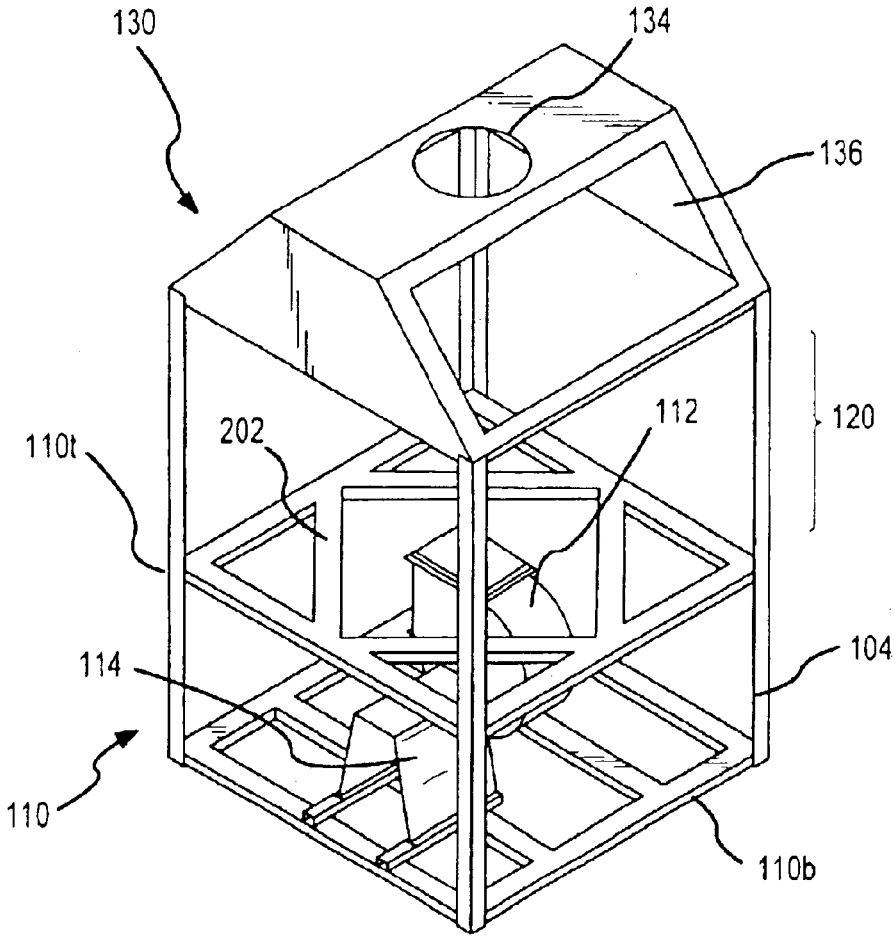
FIG. 2 shows a perspective view of the seed dryer with an air kettle and a kettle base removed consistent with at least one embodiment of the present invention.

As seen if FIG. 2, if dryer 100 is an integrated unit, then fan compartment top 110*t* is comprised of supports 202. Arrangement of supports 202 is such that kettle base 122 can rest on the supports above fan 112 such that airway opening 116 and 126 are substantially aligned.

Figure 3:
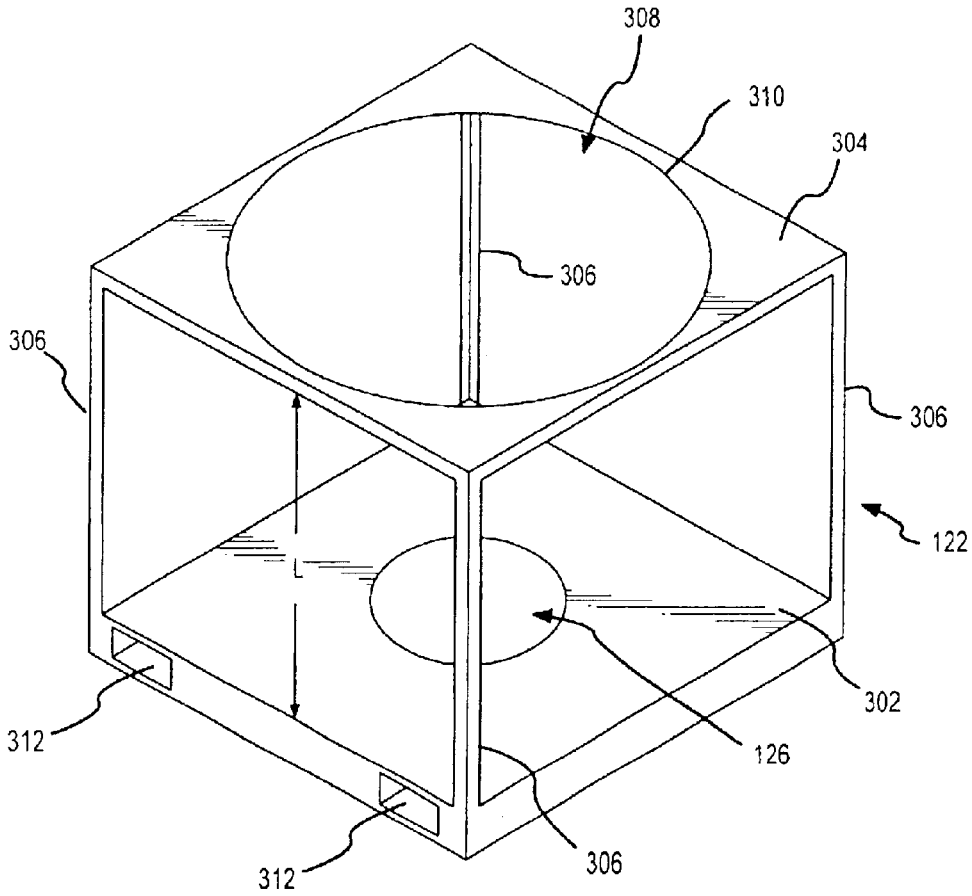
FIG. 3 is a perspective view of an air kettle base in accordance with at least one embodiment of the present invention.

Referring now to FIG. 3, a perspective view of kettle base 122 is shown in more detail. Kettle base 122 is shown as an open structure having a kettle base bottom 302 and a kettle base top 304. A plurality of supports 306 hold kettle base top 304 a distance L above kettle base bottom 302. Kettle base top 304 has an air kettle opening 308 defined by an edge 310. Kettle 124 (FIG. 1) resides in air kettle opening 308 and edge 310 provides some vertical stability. Kettle base airway opening 126 is arranged in kettle base bottom 302 such that placement of kettle base 122 in dryer 100 causes airways 116 and 126 to be substantially aligned. Optionally, to facilitate placement and removal, kettle base 302 may have one or more access ports 312. Access ports 312 are designed to receive, for example, fork lift prongs so that kettle base 122 can be removed from Dryer 100. Also, while shown as a substantially open frame device, kettle base 122 could have enclosed sidewalls. Also, opening 308 does not have to be circular but could be any geometric or random design to accept air kettle 124. Finally, but not shown, kettle base bottom 302 would have an attachment device, such as, bolt holes to mate with bolts, a slip ring, pin and detent, or the like, to allow air kettle 124 to fasten or releasably fasten to kettle base 122.

Figure 4:
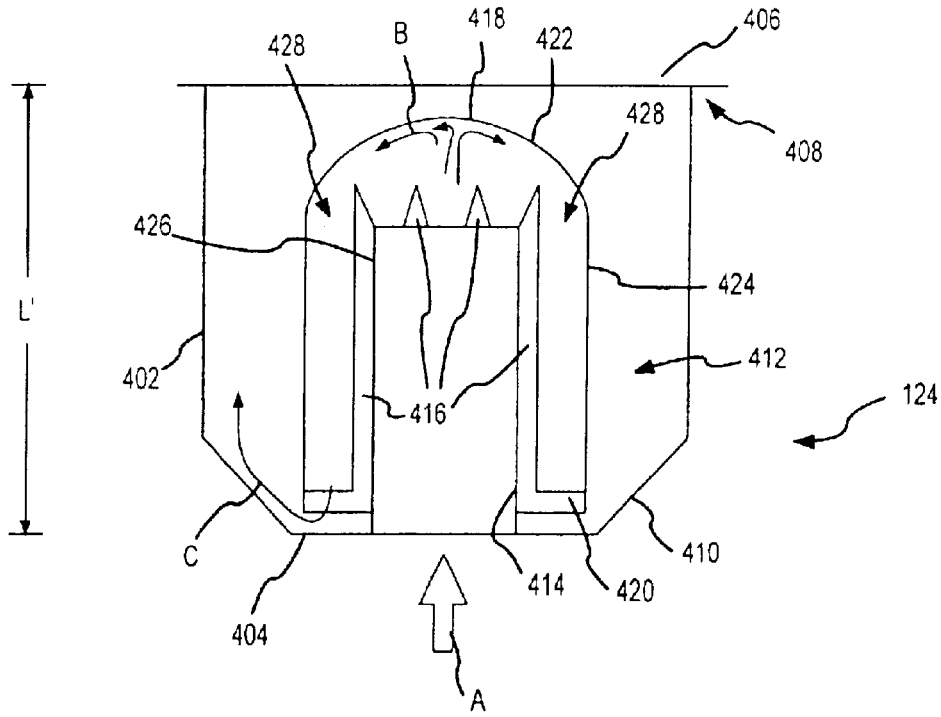
FIG. 4 is a cross-sectional view of an air kettle in accordance with at least one embodiment of the present invention.

Referring now to FIG. 4, a cross-sectional view of air kettle 124 is shown. Air kettle 124 has at least one kettle sidewall 402, a kettle bottom 404, and a kettle top 406 having a lip 408. Kettle bottom 404 is attached to kettle base 122 using a mechanism, such as bolts and bolt holes, a slip ring, a friction fit, a pin and detent, magnetics, or the like (none specifically shown). Sidewall 402 may have a sloped lower sidewall portion 410 to assist in airflow, as will be explained further below. While shown as a linear slope portion of the sidewall, sloped lower sidewall portion 410 could be arched, curved, or some other shape as a matter of design choice. If bottom 404 and sidewall 402 connected in a 90 degree angle, the air kettle would function, but the air flow would experience additional turbulence, which it is believed would reduce the efficiency of the dryer. Air kettle 124 has a vertical dimension of L'. L' should be slightly greater than L so that lip 408 resides above air kettle base top 304. Thus, sidewalls 402 and lip 408 are supported by top 304 and edge 310.

Internally, air kettle 124 comprises a seedbed 412, a plenum 414, and at least one air diffuser 418. Optionally, plenum 414 comprises at least one guide vane 416 and at least one air diffuser support 420. Diffuser 418 has outer walls 424 that fit outside walls 426 of plenum 414. Outer walls 424 of diffuser 418 and outside walls 426 of plenum 414 for air channel 428. In use, hot, dry air enters plenum 414 as shown by arrow A from fan 112 (FIGS. 1 and 2) and moves upward toward the top 422 of air diffuser 418. Top 422 is shown having a dome shape because that is believed to be the most efficient shape to equally spread the air flow in all directions, but other shapes are possible, such as, conical, triangular, elliptical, or the like. As shown by arrows B, when the hot, dry air strikes diffuser 418, the air flow is deflected towards the outer wall 424 of diffuser 418 and is guided downward by guide vanes 416 and outer wall 424. As shown by arrow C, the airflow exits underneath diffuser support 420 and curls up the lower sloped sidewall portion 410 and sidewall 402. As can be seen, while the above design is adequate, any geometric configuration would work as long as the air flow could be directed up, such as through plenum 414, directed downward, such as by top 422 of diffuser 418, and out bottom exit into seedbed 412.

While air kettle 124 having airflow from a fan up through plenum 414 as shown by Arrow A, off top 422 as shown by Arrow B, and back down channel 428 and into seedbed 412 as shown by Arrow C, it would be possible to supply air directly to channels 428 and out the bottom of seedbed 412. However, the arrangement shown in the FIGS. is believed to facilitate construction.

Airflow should be at a sufficient pressure and velocity to fluidize the seedbed to obtain even and effective seed drying. The pressures and velocities will depend on the seedbed composition, in part, and the shape of the air kettle, in part. Eventually, the airflow will exit the air kettle and escape the system via the exhaust airway opening 134.

Referring back to FIG. 4, because of the airflow pattern, pressure and velocity, no screens are necessary for operation of dryer 100. A screen could be used, such as a screen mounted between adjacent diffuser supports 420, but because seeds in seedbed 412 cannot contaminate fan 112 or the air supply, screens are not necessary. Also, because air travels underneath seedbed 412, seeds are mixed by the airflow to facilitate even and complete drying. Thus, removing the need for mechanical agitation or stirring.

FIG. 4 represents a symmetrical air kettle 124 because it is believed to be an efficient design, but it would be possible to have asymmetrical air kettles. For example, the plenum and diffuser could be offset. Moreover, while a single, central plenum and diffuser are shown, multiple plenums and diffusers could be used. If multiple plenums and diffusers are used, they could be arranged randomly, but it would be beneficial to arrange the plenums and diffusers about a geometric center axis of air kettle 124.

While the invention has been particularly shown and described with reference to an embodiment thereof, it will be understood by those skilled in the art that various other changes in the form and details may be made without departing from the spirit and scope of the invention.

We claim:

1. An air kettle for a seed dryer, comprising:

a sidewall;

the sidewall defining a seedbed;

at least one plenum;

the at least one plenum residing in the seedbed and having at least one air supply path and at least one outside wall;

at least one diffuser;

the at least one diffuser having at least one top and at least one outer wall;

the at least one top residing about the air supply path to direct air towards the at least one outer wall; and the at least one outer wall residing about the at least one outside wall such that the at least one outer wall and the at least one outside wall form at least one channel, and air directed towards the at least one outer wall enters the at least one channel and is directed to the bottom of the seedbed to direct drying air to a bottom of the seedbed, wherein air moves from the at least one air supply path to the at least one top where it is directed through the at least one channel and into the seedbed, wherein the air to dry seeds fluidizes the seeded to provide seed drying.

2. The air kettle according to claim 1, wherein the sidewall has a lower portion comprising at least one of a slope, a curve, and an arch, wherein the lower portion directs air flow and facilitates drying.

3. The air kettle according to claim 1, wherein the at least one top comprises at least one of a dome shape, a conical shape, a triangular shape, and an elliptical shape.

4. The air kettle according to claim 1, further comprising:

at least one guide vane coupled to the at least one outside wall and extending radially outward.

5. The air kettle according to claim 4, wherein the at least one guide vane comprises at least one diffuser support.

6. The air kettle according to claim 4, wherein the at least one guide vane extends radially from the at least one outside wall to the at least one outer wall.

7. The air kettle according to claim 1, wherein the at least one channel has a filter.

8. The air kettle according to claim 1, further comprising:

at least one air kettle base;

the at least one air kettle base comprising an air kettle base top and an air kettle base bottom;

the air kettle base top having an air kettle opening with an edge such that the air kettle fits in the air kettle opening and the sidewall is adjacent the edge; and the air kettle base bottom coupled to the air kettle bottom and having an airway adapted to allow gas to move from a gas supply into the plenum.

9. The air kettle according to claim 8, wherein the gas is air.

10. The air kettle according to claim 8, wherein the air kettle base bottom is coupled to the air kettle bottom using at least one of bolts, slip rings, friction fittings, detents and pins, snap locks, and magnetics.

11. A seed dryer, comprising:

a air supply compartment, the air supply compartment having an air supply opening;

a kettle compartment arranged over the air supply compartment and having a kettle compartment air supply port substantially aligned with the air supply opening; and an exhaust compartment arranged over the kettle compartment having an exhaust port, wherein the kettle compartment comprising:

a kettle, a plenum, and a diffuser, the kettle comprising a sidewall defining a seedbed, the plenum comprising an outside wall, the outside wall having a plenum air supply port and a plenum air supply exhaust and defining an air supply path from the plenum air supply port to the plenum air supply exhaust, the plenum air supply port substantially aligned with the kettle air supply port, and the diffuser comprises a top and an outer wall, the top substantially aligned with the plenum air supply exhaust, the top extending to the outer wall such that the top directs air from the air supply towards the outer wall, the outer wall extending substantially parallel to the outside wall, residing between the sidewall and outside wall, and extending from the top to a point above a bottom of the seedbed to form an diffuser air supply exhaust, such that the outside wall and outer wall form at least one channel, the at least one channel receives air directed from the top towards the outer wall and directs the air towards a bottom of the seedbed, such that drying air from the air supply is directed towards the bottom of the seedbed, wherein the air fluidizes the seedbed to provide seed drying.

12. The seed dryer according to claim 11, wherein the air supply comprises at least one of a fan, a blower, a turbine, and a jet.

13. The seed dryer according so claim 11, further comprising:

at least one guide vane extending radially outward from the outside wall of the plenum towards the outer wall of the diffuser.

14. The seed dryer according to claim 11, further comprising a jet at the diffuser air supply exhaust.

15. The seed dryer according to claim 11, wherein the exhaust compartment comprises a viewing window.

16. The seed dryer according to claim 15, wherein the viewing window comprises at least one of an opening, a see through panel, and a hingedly connected panel.

17. A kettle for use in a seed dryer, the kettle comprising:

a sidewall, a kettle top, and a kettle bottom;

the sidewall, the kettle top, and the kettle bottom defining a seedbed;

at least one plenum, the at least one plenum comprising an air supply opening, outside walls, and an air supply exhaust, the outside walls defining an air supply path;

the at least one plenum residing in the seedbed such that the air supply opening resides towards the kettle top and the air supply exhaust resides towards the kettle bottom; and at least one diffuser substantially aligned with the at least one plenum such that air traveling along the air supply path is directed towards the air supply exhaust; such that air moves enters the air supply opening adjacent the kettle top, travels down through the seedbed along the air supply path to the air supply exhaust and into the bottom or the seedbed wherein the air fluidizes the seedbed to provide seed drying.

18. The kettle according to claim 17, wherein at least one jet is coupled to the air supply exhaust.

* * * * *